US008251217B2

(12) United States Patent
Hemmerlin et al.

(10) Patent No.: US 8,251,217 B2
(45) Date of Patent: Aug. 28, 2012

(54) PACKAGING POUCH

(75) Inventors: David Hemmerlin, Muespach le Hauf (FR); Francis Lovell, Montreuil (FR); Isabelle Suire, Arcueil (FR)

(73) Assignee: Novartis AG, Basel (CH)

( * ) Notice: Subject to any disclaimer, the term of this patent is extended or adjusted under 35 U.S.C. 154(b) by 0 days.

(21) Appl. No.: 12/867,948

(22) PCT Filed: Feb. 19, 2009

(86) PCT No.: PCT/EP2009/051994
§ 371 (c)(1),
(2), (4) Date: Aug. 17, 2010

(87) PCT Pub. No.: WO2009/103771
PCT Pub. Date: Aug. 27, 2009

(65) Prior Publication Data

US 2010/0326877 A1 Dec. 30, 2010

(30) Foreign Application Priority Data

Feb. 21, 2008 (EP) ..... 08151748

(51) Int. Cl.
*B65D 83/04* (2006.01)

(52) U.S. Cl. ..... 206/532; 383/200; 383/210

(58) Field of Classification Search ..... 206/532, 206/466, 469, 528, 530, 484, 484.1, 484.2; 383/200, 207, 208, 209, 210, 210.1; 229/87.05, 229/125.35
See application file for complete search history.

(56) References Cited

U.S. PATENT DOCUMENTS

| | | | | |
|---|---|---|---|---|
| 3,809,220 | A * | 5/1974 | Arcudi | 206/484 |
| 4,982,845 | A * | 1/1991 | Prascak et al. | 229/87.05 |
| 5,899,333 | A * | 5/1999 | Williams et al. | 206/469 |
| 6,360,916 | B1 * | 3/2002 | Sokolsky et al. | 222/107 |
| 7,607,834 | B2 * | 10/2009 | Alvater et al. | 383/210 |
| 7,757,855 | B2 * | 7/2010 | Jarvis et al. | 206/524.1 |
| 2006/0023976 | A1 * | 2/2006 | Alvater et al. | 383/210 |
| 2008/0105582 | A1 | 5/2008 | Ludwig et al. | |

FOREIGN PATENT DOCUMENTS

WO WO 2007/007035 A1 1/2007

* cited by examiner

*Primary Examiner* — J. Gregory Pickett
*Assistant Examiner* — Andrew Perreault
(74) *Attorney, Agent, or Firm* — Carmella A. O'Gorman

(57) ABSTRACT

The invention relates to a pouch for containing a product. The pouch comprises a first wall and a second wall which are sealed together in sealed regions. The sealed regions substantially surround a compartment portion within which a product can be located. The pouch includes a tear initiating weakness located away from an edge of the pouch, the tear initiating weakness comprising an elongate weakness which extends along a first axis such that a user can fold the pouch across the tear initiating weakness and initiate a tear from the folded edge substantially along the first axis, the pouch further comprises at least one tear guiding weakness, said tear guiding weakness extending along a second axis transverse to the first axis such that a tear extending substantially along the first axis will meet the at least one tear guiding weakness and be guided along the second axis.

11 Claims, 1 Drawing Sheet

PACKAGING POUCH

This application is a National Phase application of PCT/EP2009/051994, filed Feb. 19, 2009, which claims benefit of EP 08151748.4, filed Feb. 21, 2008.

The present invention relates to a packaging pouch for containing a product, particularly a pouch for containing a medicament product and more particularly to a pouch for containing a medicament which pouch includes child resistant opening features.

Pouches can be used for containing products, particularly medicaments such as tablets, capsules, patches or powders, in order to prevent or limit exposure to contaminants such as dirt or moisture, or to provide a predetermined quantity of product that may, for example, constitute a single 'dose'. The pouch can act as external packaging within which a product is contained in inner packaging and/or the pouch can be contained within additional external packaging.

To obtain access to an interior compartment of a pouch containing the product users typically have to tear off a portion of a pouch. The tearing off of a portion of the pouch provides an opening through which the content of the pouch can be dispensed from the interior compartment. It is known to provide a tear notch, such as an elongate cut, such that a user can fold the pouch along a fold line that passes through the tear notch and then use the tear notch to initiate a tear.

The invention provides a pouch for containing a product, the pouch comprising a first wall and a second wall, the first wall and second wall being sealed together in sealed regions, the sealed regions substantially surrounding a compartment portion within which a product can be located, the pouch including a tear initiating weakness located away from an edge of the pouch, the tear initiating weakness comprising an elongate weakness which extends along a first axis and arranged such that a user can fold the pouch across the tear initiating weakness and initiate a tear from the folded edge substantially along the first axis using said tear initiating weakness, the pouch further comprises at least one tear guiding weakness, said tear guiding weakness extending along a second axis transverse to the first axis such that a tear extending substantially along the first axis will meet the at least one tear guiding weakness and be guided along the second axis.

Locating a tear initiating weakness away from an edge of the pouch hinders tear initiation from an edge of the pouch. A user must fold the pouch such that the fold line passes through the tear initiating weakness so that a tear can be initiated using said weakness, the tear initiating weakness facilitates tear initiation. By providing a tear guiding weakness in addition to a tear initiating weakness the tear can be initiated in a convenient position in which, for example, a long fold might not be required, but the tear can then be re-directed by the tear guiding weakness in a direction that is potentially more useful to open the pouch and access the contents.

The tear guiding weakness may be located within a sealed region. The weaknesses may be formed by any suitable method such as cutting, laser etching, mechanical scoring or perforations. The weakness may be formed in one or all layers of the pouch. It should be understood that the weaknesses need not all be formed by the same method. For example is may be preferred that, for example the tear initiating weakness is weaker (easier to tear along, or in fact already separated) than tear guiding weaknesses. For example the tear initiating weakness may be formed by a cut through all layers of the pouch, while which the tear guiding weaknesses are formed by laser etching.

The tear initiating weakness may be less than 10 mm long and may be less than 5 mm long.

The first and second walls can be fabricated from any suitable material and need not be of the same material. The first and second walls may be fabricated from a flexible film material which may be a laminate or composite material. The film may be a plastics laminate and may include a moisture barrier layer.

The pouch may be substantially rectangular in shape. However, it should be understood that the pouch could be formed in any suitable shape, for example substantially triangular, substantially circular or an irregular shape if desired. The first and second walls may be fabricated by folding a single strip of film substantially in half. The sealed regions may extend substantially entirely around the periphery of the pouch.

The first axis extends substantially from a corner of the pouch towards the compartment as this enables a short fold to be made in which the fold line intersects the tear initiating weakness. For a substantially rectangular pouch the first axis may extend from a corner towards the compartment at an angle of between 40 and 50° to a side of the pouch.

For a rectangular pouch the second axis may be substantially parallel with an edge of the pouch as this promotes a long tear which could substantially remove a side of the pouch.

The sealing of the first and second walls together can be achieved in a variety of conventional ways which will not be discussed in detail. Within the compartment the first and second walls are not sealed together so the walls and seals cooperate to enclose a volume within which a product such as a medicament can be stored.

There may be two tear guiding weaknesses, one extending along the second axis as described above and the other extending along a third axis. The second and third axis may extend transverse to one another and also to the first axis. By providing two tear guiding weaknesses the pouch can be more suitable for use by both left and right handed users as each would tend to tear a pouch open along a different axis as they would tend to use different hands to hold the pouch and pull on an edge to tear open the pouch. A second tear guiding weakness can also provide a second chance for a user to initiate a tear should the tear initially begun not correctly open the pouch.

The, or each, tear guiding weakness may be less than 10 mm long and may be less then 5 mm long. In a different embodiment the, or each, tear guiding weakness may extend along its associated axis until a near edge of the compartment is reached, a far edge of the compartment is reached, or an edge of the pouch is reached.

The tear guiding weaknesses may be located wholly within a sealed region, wholly within the compartment, or may extend between the sealed region and the compartment.

The tear guiding weaknesses may not be linear and could be shaped to guide the tear along a particular line to ensure a particular opening is created.

One or both of the second axis and third axis may pass through the compartment as this would facilitate access to the content of the pouch after a tear has been guided substantially along said axis.

The two tear guiding weaknesses may intersect substantially on the first axis. This would result in a 'V' or 'X' shaped weakness with the intersection substantially on the first axis and the weaknesses extending away. In one embodiment the tear guiding weaknesses extend away from the intersection in a preferred tear direction only so the tear guiding weaknesses form a 'V'. For a rectangular pouch the second and third axes may extend substantially perpendicular to one another. Each axis may extend substantially parallel with an adjacent edge of the pouch so that if the pouch were substantially rectangular the axes would be substantially perpendicular.

In one embodiment the tear initiating weakness also intersects with the or each tear guiding weakness. In one embodiment the resulting arrangement is of a 'Y' shaped weakness.

In a different embodiment the tear initiating weakness does not intersect with the tear guiding weaknesses as this can provide a stronger arrangement which resists piercing pressure from, for example, a finger of a user or child.

If the tear initiating weakness does not intersect with a tear guiding weakness there may be a guide extension weakness which extends from the tear guiding weakness along the first axis towards, but not meeting, the tear initiating weakness. The guide extension weakness may be a single elongate weakness or and may be formed of a series of perforations. This arrangement is slightly more complex, but separates the tear initiating weakness from the tear guiding weaknesses while retaining a guide for the tear so that the initial tear meets the tear guiding weaknesses substantially on the first axis.

The pouch may include indicia indicting a fold line along which a user should fold the pouch. The indicated fold line should passing through the tear initiating weakness and signal that a user can initiate a tear from the tear initiating weakness after folding of the pouch. The tear initiating weakness is located away from an edge of the pouch to hinder tear initiation from an edge of the pouch, thereby increasing child resistance. The material selection can by made to ensure that tear initiation from an edge of the pouch is difficult, but once a tear is initiated using a tear initiation weakness a user can propagate said tear through the material.

The compartment of the pouch described can contain a medicament, for example one or more tablets or capsules, powdered medicament or other medicament forms such as patches or films.

It should be understood that throughout this specification and in the claims that follow, unless the context requires otherwise, the word "comprise", or variations such as "comprises" or "comprising", implies the inclusion of the stated integer or step, or group of integers or steps.

The invention will now be further described, by way of example only, with reference to the following drawings in which.

Figure 1:
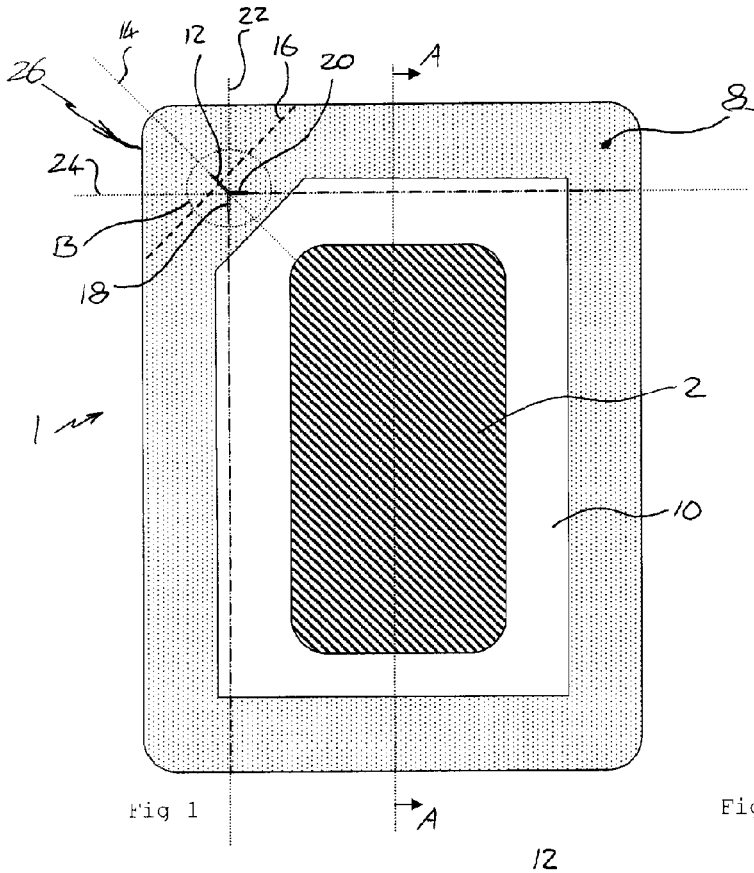
FIG. 1 shows a schematic plan view of a pouch.
Figure 2:
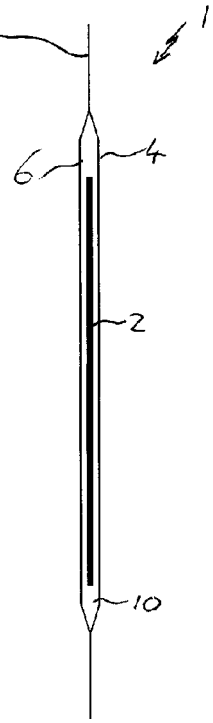
FIG. 2 shows a cross section of the pouch of FIG. 1 along the line A-A.

FIGS. 1 and 2 shows a pouch 1 in a schematic plan view and in cross section along the line A-A respectively. The pouch 1 contains product 2, in this case a medicated patch. The pouch 1 comprising a first wall 4 and a second wall 6 which are sealed together in sealed regions 8 to form the pouch.

The sealed regions 8 substantially surround a compartment portion 10 within which the product 2 is located. The pouch includes a tear initiating weakness 12 located away from an edge of the pouch and within a sealed region 8. The tear initiating weakness 12 comprises an elongate weakness which extends along a first axis 14. The tear initiating weakness 12 is arranged such that a user can fold the pouch across the tear initiating weakness 12 and initiate a tear from the folded edge substantially along the first axis 14 using said tear initiating weakness 12. The pouch includes a fold indicating indicia 16, in this case printed on the pouch 1 as a guide for users to indicate where the pouch 1 should be folded. The pouch 1 further comprises two tear guiding weaknesses 18,20 which along a second axis 22 and a third axis 24 respectively.

The tear initiating weakness 12 extends from a corner of the pouch along the first axis 14 which extends at between 40° and 50°, in this case at substantially 45°, to each adjacent edge of the substantially rectangular pouch 1. The second and third axes 22,24 extend substantially parallel with the adjacent edge of the pouch 1 and pass through the compartment 10.

The perimeter of the compartment 10 is defined by the sealed regions and is not the same shape as the perimeter of the pouch 1. In this case the sealed region 8 extends further towards a centre of the pouch 1 in a corner 26 of the pouch 1 which includes the weaknesses 12,18,20. Such an arrangement of the sealed region 8 allows the tear guiding weaknesses to extend substantially parallel with the adjacent edge of the pouch 1 and pass through the compartment 10. It should be understood that the second and third axes may not extend parallel with an adjacent edge of the pouch 1 and still pass through the compartment 10.

The arrangement of the tear initiating weakness 12 and tear guiding weaknesses 18,20 will be explained in more detail with reference to FIGS. 3,4 and 5 which show detailed views of the portion B for FIG. 1.

Figure 3:
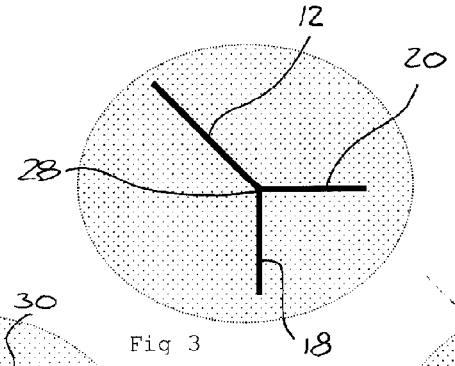
FIG. 3 shows a detail view of a first embodiment of the portion B of FIG. 1.

FIG. 3 shows a 'Y' shaped embodiment of the weaknesses 12,18 and 20. In this case the weaknesses 12,18 and 20 all meet at an apex 28 and are formed by cutting through the first and second layers 4,6 of the pouch. A tear is initiated by folding the pouch 1 through the tear initiating weakness 12 and using said weakness to initiate a tear using the tear initiating weakness 12. Since the tear initiating weakness extends to the apex 28 the user can then choose along which edge they wish to open the pouch 1 and propagate the tear along either the second or third axis 22,24 guided by one of the guide weaknesses 18,20. If for any reason the tear in the first direction fails, the tear guiding weakness not initially selected can be use to initiate a tear along the other axis.

Figure 4:
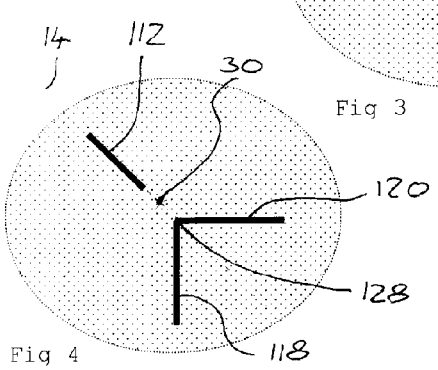
FIG. 4 shows a second embodiment of portion B.

FIG. 4 shows a broken 'Y' shaped embodiment of the weaknesses. Features which function in the same way as previous FIGS. 1 to 3 will be referred to by their previous reference numbers incremented by 100. The guide weaknesses 118,120 meet at an apex 128 which is located on the first axis 14. The tear initiating weakness 112 is separated from the guide weaknesses 118,120 by a non-weakened region 30.

Figure 5:
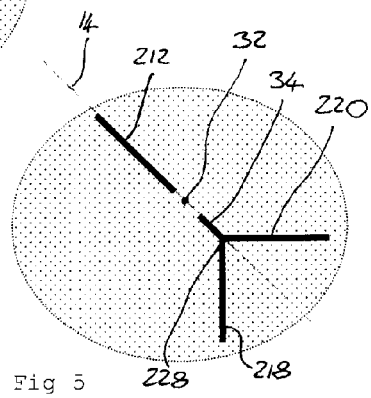
FIG. 5 shows a third embodiment of portion B.

FIG. 5 shows a different broken 'Y' shaped embodiment of the weaknesses. Features which function in the same way as previous FIGS. 1 to 3 will be referred to by their previous reference numbers incremented by 200. The guide weaknesses 218,220 meet at an apex 228 which is located on the first axis 14. The tear initiating weakness 212 is separated from the guide weaknesses 218,220 by a non-weakened region 32. In this embodiment there is a guide extension weakness 34 which extends from the apex along the first axis 14 towards the tear initiating weakness 212.

It should be understood that the invention has been described above by way of example only and that modification sin detail can be made without departing from the scope of the claims.

The invention claimed is:

1. A pouch for containing a product, the pouch comprising at least a first wall, a second wall, an edge and a corner, the first wall and second wall being sealed together in sealed regions, the sealed regions substantially surrounding a compartment portion within which a product can be located, the pouch including a tear initiating weakness located in the sealed region away from an edge of the pouch and extending substantially from the corner of the pouch towards the compartment along a first axis, the tear initiating weakness comprising an elongate weakness which extends along the first axis and arranged such that a user can fold the pouch across the tear initiating weakness and initiate a tear substantially along the first axis using said tear initiating weakness, the pouch further comprising at least one tear guiding weakness extending along a second axis transverse to the first axis such that a tear initiated at the tear initiating weakness will meet the at least one tear guiding weakness and be guided along the second axis and through the compartment.

2. A pouch as claimed in claim 1, in which there are two tear guiding weaknesses, one extending along the second axis and the other extending along a third axis, the second and third axis extending transverse to one another and to the first axis and the third axis passing through the compartment.

3. A pouch as claimed in claim 2, in which the tear guiding weaknesses intersect substantially on the first axis.

4. A pouch as claimed in claim 3, in which the tear initiating weakness also intersects with the tear guiding weaknesses.

5. A pouch as claimed in claim 3, in which the tear initiating weakness does not intersect with the tear guiding weaknesses.

6. A pouch as claimed in claim 1, in which the tear initiating weakness does not intersect with a tear guiding weakness and in which a guide extension weakness extends from the tear guiding weakness along the first axis towards, but not meeting, the tear initiating weakness.

7. A pouch as claimed in claim 1, in which the pouch is substantially rectangular, the sealed regions extend substantially entirely around the periphery of the pouch and the first axis extends substantially from a corner towards the compartment.

8. A pouch as claimed in claim 7, in which the first axis extends from a corner towards the compartment at an angle of between 40° and 50° to a side of the pouch.

9. A pouch as claimed in claim 7, in which the second axis is substantially parallel with an edge of the pouch.

10. A pouch as claimed in claim 8, in which there are two tear guiding weaknesses and a third axis along which one of the tear guiding weaknesses extends substantially perpendicular to the second axis.

11. A pouch as claimed in claim 1, in which the compartment contains a medicament product.

* * * * *